US006249205B1

(12) United States Patent
Meadors et al.

(10) Patent No.: US 6,249,205 B1
(45) Date of Patent: Jun. 19, 2001

(54) SURFACE MOUNT INDUCTOR WITH FLUX GAP AND RELATED FABRICATION METHODS

(75) Inventors: Richard W. Meadors, Chattanooga; James A. Smith, Soddy Daisy, both of TN (US); Craig P. Cameron, Lyons, CO (US); Phuong Le, Hixson, TN (US)

(73) Assignee: Steward, Inc., Chattanooga, TN (US)

( * ) Notice: Subject to any disclaimer, the term of this patent is extended or adjusted under 35 U.S.C. 154(b) by 0 days.

(21) Appl. No.: 09/197,743

(22) Filed: Nov. 20, 1998

(Under 37 CFR 1.47)

(51) Int. Cl.[7] ..... H01F 5/00

(52) U.S. Cl. ..... 336/200; 336/83; 336/178

(58) Field of Search ..... 336/200, 236, 336/233, 178, 83

(56) References Cited

U.S. PATENT DOCUMENTS 4,117,588 * 10/1978 Johnson ..... 336/200
4,547,961 * 10/1985 Bokil et al. ..... 336/200
4,959,631 * 9/1990 Hasegawa et al. ..... 336/200
5,250,923 * 10/1993 Ushino et al. ..... 336/200

FOREIGN PATENT DOCUMENTS 5-82736 * 4/1993 (JP) .

* cited by examiner

*Primary Examiner*—Lincoln Donovan
*Assistant Examiner*—Tuyen T. Nguyen
(74) *Attorney, Agent, or Firm*—Allen, Dyer Doppelt Milbrath & Gilchrist, P.A.

(57) ABSTRACT

An inductor, such as for electromagnetic interference (EMI) suppression, comprises a plurality of ferrite layers arranged in stacked relation and joined together to define a ferrite body, and a first electrical conductor extending between a first pair of adjacent ferrite layers. The inductor includes first respective opposing portions of the first pair of adjacent ferrite layers being sintered together, and second respective opposing portions of the first pair of adjacent ferrite layers being in spaced apart relation to define at least one first gap therebetween. Moreover, the device includes a sintering blocking material associated with the at least one first gap. The sintering blocking material causes the gap to form in the ferrite body to selectively block the magnetic path to thereby retain a higher inductance than would otherwise be possible at relatively high currents. In a surface mounting embodiment of the inductor, the ferrite body has a generally rectangular shape. In addition, a pair of end conductors are provided on opposing ends of the ferrite body to facilitate surface mounting of the inductor. The sintering blocking material may comprise a non-magnetic material. In particular, the sintering blocking material may comprise titanium-dioxide.

29 Claims, 7 Drawing Sheets

SURFACE MOUNT INDUCTOR WITH FLUX GAP AND RELATED FABRICATION METHODS

FIELD OF THE INVENTION

This invention relates to the field of electronic devices, and, more particularly, to the field of ferrite inductors, such as for electromagnetic interference (EMI) suppression or ripple smoothing in low power converters.

BACKGROUND OF THE INVENTION

A typical ferrite surface mount multilayer inductor includes a generally rectangular ferrite body with an electrically conductive path extending therethrough. The electrically conductive path, in turn, is connected to respective conductive coating layers on opposite ends of the ferrite body to facilitate connection to a printed circuit board, for example. Such a ferrite component may commonly be manufactured by printing a plurality of interconnected conductive traces on successive stacked ferrite layers.

U.S. Pat. No. 4,543,553 to Mandai et al. entitled "Chip-Type Inductor" discloses a chip inductor comprising a plurality of laminated magnetic layers. Linear conductive patterns extend between the respective magnetic layers, and these linear conductive patterns are connected successively to define a coil so as to produce an inductance component. The conductive patterns on opposite surfaces of the magnetic layers are connected to each other by through-holes or vias wherein the conductors are deformed to plunge through the holes to establish electrical contact.

Another device is disclosed in U.S. Pat. No. 4,689,594 to Kawabata et al. entitled "Multi-Layer Chip Coil." In this patent a multi-layer chip coil comprises a stack of intermediate layers of magnetizable material having a through-hole defined therein so as to extend completely through the thickness thereof. First and second patterned electrical conductors are formed on the opposite surfaces of each of the intermediate layers, and a hollow tubular conductive layer extends through the through-hole so as to connect adjacent conductors.

Still another device is disclosed in U.S. Pat. No. 5,302,932 to Person et al. entitled "Monolithic Multilayer Chip Inductor and Method For Making Same." This patent discloses a monolithic multilayer chip inductor which includes a plurality of subassemblies stacked one above another. Each of the intermediate subassemblies includes a ferrite layer having a coil conductor with a uniform width printed on its upper surface. The intermediate ferrite layers include via holes therein for permitting interconnection of the conductor coils from one layer to the other. In addition, one end of the top coil conductor is exposed adjacent the edge of the chip, and one end of the bottom coil conductor is exposed adjacent another end of the chip so that the conductors can be connected to end terminals. Unfortunately, great accuracy may be required in assembling the layers to provide sufficient electrical contact between each vertical conductor and the relatively narrow lateral conductors.

Pending U.S. patent application Ser. No. 08/445,475) entitled "High Current Ferrite Electromagnetic Interference Suppressor and Associated Method", and assigned to the assignee of the present invention, discloses a significant improvement in a ferrite inductor having high current handling capability. The laterally extending conductors may be made relatively thick and include enlarged width portions to connect to vertically extending electrical conductors. Unfortunately, the device may still become saturated at high currents, and, thus, be unable to provide a desired relatively high inductance at these higher operating currents as needed in certain applications.

SUMMARY OF THE INVENTION

In view of the foregoing background, it is therefore an object of the present invention to provide an inductor, such as for EMI suppression or ripple smoothing, particularly of the surface mount type, for carrying a relatively high current that is readily manufacturable and which provides a relatively high inductance.

It is another object of the present invention to provide a manufacturing method for such an inductor.

These and other objects, features and advantages in accordance with the present invention are provided by an inductor comprising a plurality of ferrite layers arranged in stacked relation and joined together to define a ferrite body. A first electrical conductor extends between a first pair of adjacent ferrite layers. In addition, the inductor includes first respective opposing portions of the first pair of adjacent ferrite layers being sintered together, and second respective opposing portions of the first pair of adjacent ferrite layers being in spaced apart relation to define at least one first air gap therebetween. Moreover, the device includes a sintering blocking material associated with the at least one first air gap. The sintering blocking material selectively causes an air gap to form during sintering of the ferrite layers to thereby create an air gap which will block the magnetic flux path. The resulting inductor can retain a higher inductance than could an ungapped conventional device, even at relatively high currents.

In a surface mounting embodiment of the inductor the ferrite body has a generally rectangular shape. In addition, a pair of end conductors are provided on opposing ends of the ferrite body to facilitate the surface mounting of the inductor.

The sintering blocking material may comprise a non-magnetic material. In particular, the sintering blocking material may comprise titanium-dioxide, for example. The sintering blocking material may be at least partially diffused into adjacent ferrite layer portions during the sintering operation.

In some embodiments of the invention, the first electrical conductor defines at least a portion of a first loop. The first air gap is defined within the first loop.

Of course, the inductor may include multiple ferrite layers and multiple conductors to thereby define a longer coil path through the ferrite body. In particular, the inductor may include a second electrical conductor extending between a second pair of adjacent ferrite layers, and have first respective opposing portions of the second pair of adjacent ferrite layers being sintered together and second respective opposing portions of the second pair of adjacent ferrite layers being in spaced apart relation to define at least one second air gap therebetween. The sintering blocking material is also preferably associated with the at least one second air gap to form the gap during sintering.

In one particularly advantageous embodiment of the inductor, the first electrical conductor and the second electrical conductor are outermost electrical conductors. In this embodiment two gaps are provided at the upper and lowermost electrical conductors, and preferably within the loops defined by each.

At least one of the ferrite layers preferably has at least one via extending therethrough. Accordingly, the inductor preferably further comprises an electrical conductor extending vertically through the at least one via. The vertical conductor can connect the adjacent electrical conductors to define a coil path through the ferrite body. To facilitate manufacturing tolerances and retain high current handling capability, the laterally extending electrical conductors preferably include enlarged width portions aligned in registration with each vertical electrical conductor.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
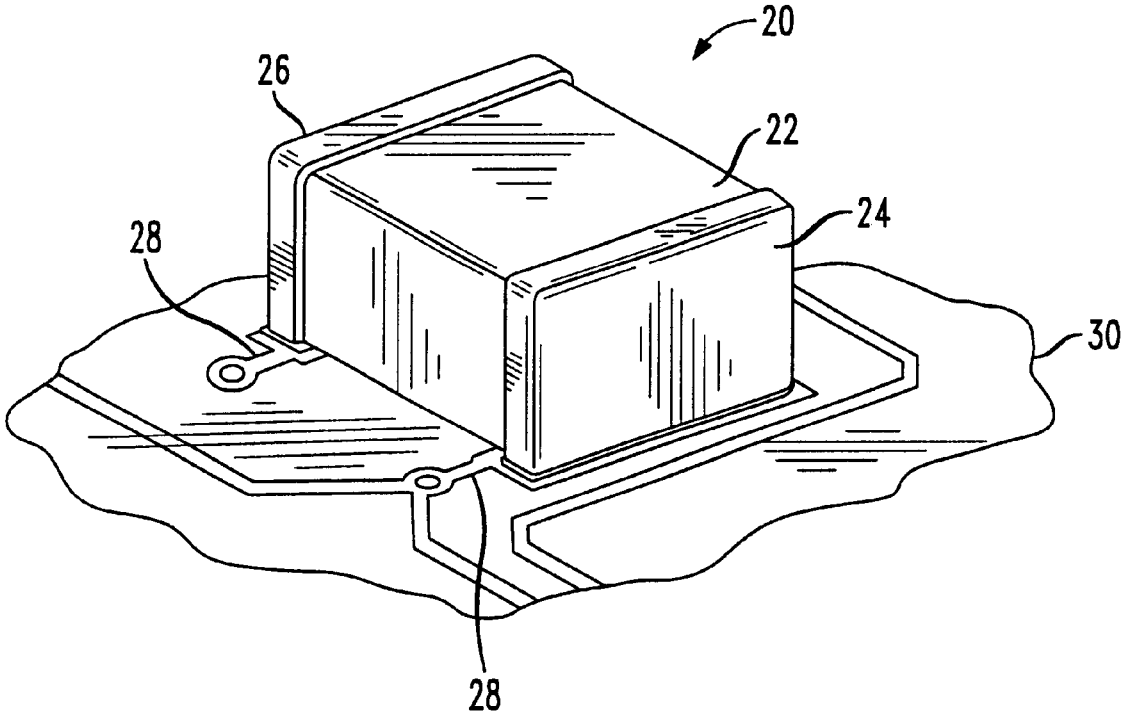
FIG. 1 is a perspective view of the inductor in accordance with the present invention installed on a circuit board in a surface mount configuration.
Figure 2:
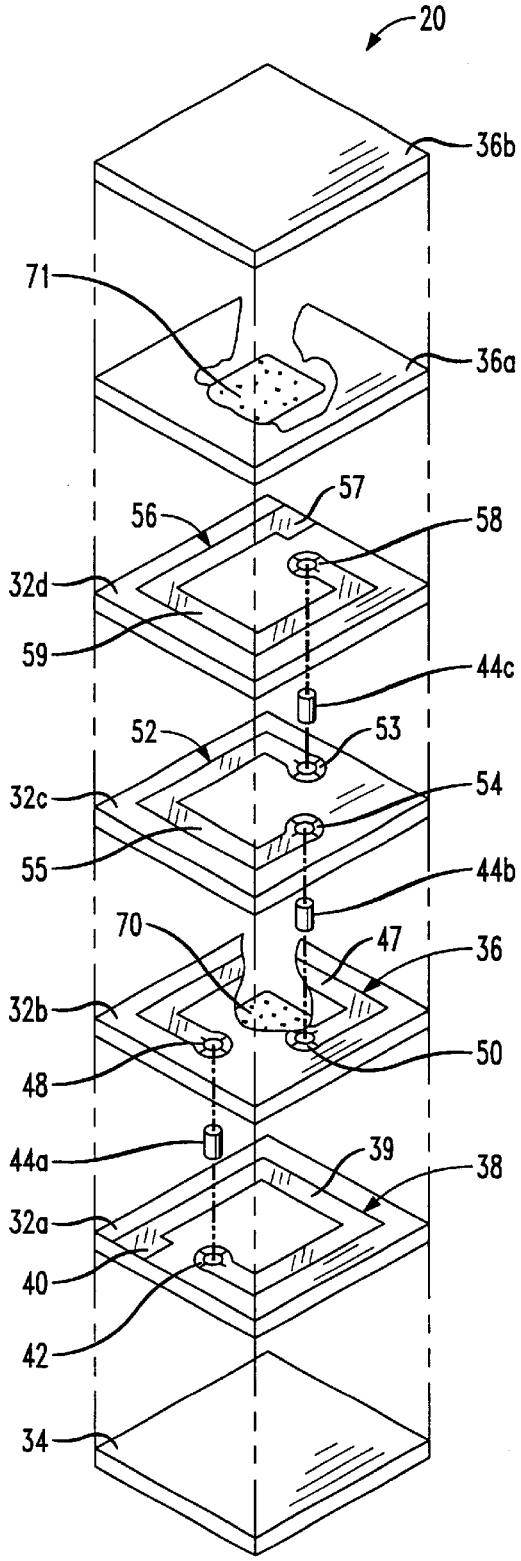
FIG. 2 is an exploded view of the inductor of FIG. 1.
Figure 3:
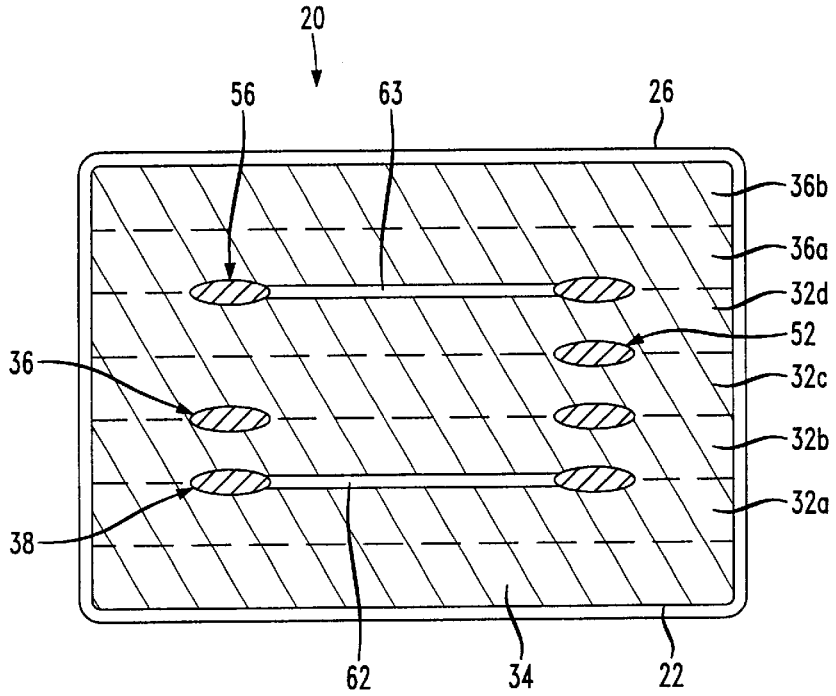
FIG. 3 is an enlarged transverse cross-sectional view of the inductor as shown in FIG. 1 and illustrating the air gaps formed in the ferrite body.

Referring initially to FIGS. 1 to 3, an inductor 20 in accordance with the invention is first described. The inductor 20 comprises a plurality of ferrite layers 32*a*–32*d*, 34, 36*a* and 36*b* arranged in stacked relation and joined together to define a ferrite body 22. One bottom ferrite layer 34 is shown in the illustrated embodiment, along with two top ferrite layers 36*a*, 36*b*. Accordingly, two thickness of the ferrite layers are provided to cover the uppermost electrical conductor and the lowermost electrical conductor. In other embodiments, different numbers of bottom and top ferrite layers may be provided as will be readily appreciated by those skilled in the art.

The illustrated inductor 20 also includes four intermediate ferrite layers 32*a*–32*d* each of which includes a respective laterally extending electrical conductor thereon. The lowest or first intermediate ferrite layer 32*a* includes an electrical conductor 38 thereon, and wherein the electrical conductor includes an end termination portion 40, a generally U-shaped portion 39, and an enlarged width portion 42. Considered in somewhat different terms, the electrical conductor 38 has at least a partial loop shape.

The second intermediate layer 32*b* includes a lateral electrical conductor thereon indicated by reference numeral 46. The electrical conductor 46 includes two enlarged width portions 48, 50 connected by a generally U-shaped portion 47. Similarly, the third intermediate ferrite layer 32*c* includes a lateral electrical conductor 52 including two enlarged width portions 53, 54 connected by a generally U-shaped portion 55. The fourth intermediate ferrite layer 32*d* also includes a lateral electrical conductor 56, which, in turn, includes an end termination portion 57 and an enlarged width portion 58 connected by a generally U-shaped portion 59.

The lowermost electrical conductor 38 is electrically connected to the second electrical conductor 46 by the illustrated vertically extending conductor 44*a*. Along these lines, the second electrical conductor 46 is electrically connected to the third electrical conductor 52 by the illustrated vertically extending electrical conductor 44*b*. Lastly, in the illustrated embodiment, the third electrical conductor 52 is electrically connected to the fourth electrical conductor 56 by the vertical conductor 44*c*. Of course, the vertically extending conductors extend through vias or openings punched in the respective ferrite layer as will be readily appreciated by those skilled in the art. The vertical conductors 44*a*–44*c* may be formed by applying a conductive paste within the respective vias. In other embodiments, a group of adjacent vertically extending conductors may be provided in place of the single illustrated vertical conductor as disclosed, for example, in U.S. patent application Ser. No. 08/445,475, filed May 22, 1995, now U.S. Pat. No. 5,821,846, referenced above and the entire disclosure of which is incorporated herein by reference. In addition, the vertical conductors may be either tubular or solid.

The combination of the lateral and vertical electrical conductors define a coil or spiral conductive path through the ferrite body 22. In other embodiments, only a single electrical conductor or other numbers of electrical conductors may be provided on a respective number of ferrite layers. The four lateral electrical conductor embodiment inductor 20 illustrated is advantageous because the coil configuration can be readily achieved and the terminals of the inductor made available for connection to an external circuit at opposite ends of the device. More particularly, end conductors 24, 26 are illustratively provided for facilitating surface mount attachment as by soldering to the circuit board traces 28 of the circuit board 30 of FIG. 1 as will be readily appreciated by those skilled in the art.

In accordance with the present invention, desirable relatively high inductance values are obtained by the inductor 20 despite carrying relatively high currents. This advantageous property is achieved through the creation of air gaps 62, 63 in the magnetic flux path through the generally rectangular ferrite body 22 as shown in the cross-sectional view of FIG. 3. These air gaps 62, 63 are achieved by providing a sintering blocking material in selected portions of the stacked ferrite layers.

More particularly, as shown in the exploded view of FIG. 2, a layer of sintering blocking material 71 is deposited on the underside of the ferrite layer 32*b*. This sintering blocking material will thus be positioned within the boundaries of the partial ring or loop defined by the first lateral electrical conductor 38. Similarly, a layer of sintering blocking material 71 is provided on the underside of the upper ferrite layer 36*a* in the illustrated embodiment. A small spacing of about 0.010 inches may be left between the edge of the sintering blocking material and the adjacent portion of the electrical conductor. The layers or patches of sintering blocking material 70, 71 may be screen printed in position on the respective undersides of ferrite layers 32*b*, 36*a*. Alternately, the sintering blocking material may be deposited or otherwise positioned on the ferrite layers within the loops defined by the respective electrical conductors as will be readily appreciated by those skilled in the art.

The sintering blocking material may preferably comprise titanium dioxide which is a non-magnetic material and which will prevent the adjacent ferrite layer portions from sintering together during the sintering step in the device fabrication. Other materials such as aluminum oxide may also be used which have similar properties. The sintering blocking material may remain in the gap between the adjacent opposing ferrite layer portions, or some, or all of the material may be diffused into the ferrite material as the ferrite material is somewhat porous as will be readily appreciated by those skilled in the art.

Considered in other terms, the inductor 20 includes first respective opposing portions of at least one first pair of adjacent ferrite layers being sintered together, and second respective opposing portions of the pair of adjacent ferrite layers being in spaced apart relation to define at least one air gap therebetween. These first and second portions are readily seen along the boundary between the ferrite layer 32*a* and the adjacent ferrite layer 32*b* as shown in FIG. 3. The outer edge portions surrounding the electrical conductor 38 are sintered together as there is no material at the boundary or interface to prevent such sintering. However, the interface within the partial loop defined by the electrical conductor 38 is effected by the sintering blocking material 70 (FIG. 2) and causes the lower air gap 62 to be formed. This same technique is used to form the upper air gap 63 as also shown in the cross-section of FIG. 3. Of course other similar devices could include only a single air gap or more than two air gaps as will be readily understood by those skilled in the art.

In the illustrated embodiment of the inductor 20 the air gaps 63, 62 are used to break the magnetic flux path and retain a relatively high inductance even at relatively high operating currents as will be described in an example below. It should also be noted that in some embodiments, the air gap is formed, but in other embodiments, the non-magnetic material of the sintering blocking material may remain to partially fill or completely fill the gap to thereby block the flux path between opposing ferrite layer portions. Typically the sintering blocking material will prevent the joining together of the opposing ferrite portions, and air will be retained in the gap due to the porosity of the ferrite material as will be readily understood by those skilled in the art. Accordingly, the sintering blocking material need not be limited to the examples provided herein, rather, the material need only be non-magnetic and preferably not be so volatile at the sintering temperatures as to be ineffective for blocking the sintering of the opposing ferrite portions.

Figure 5:
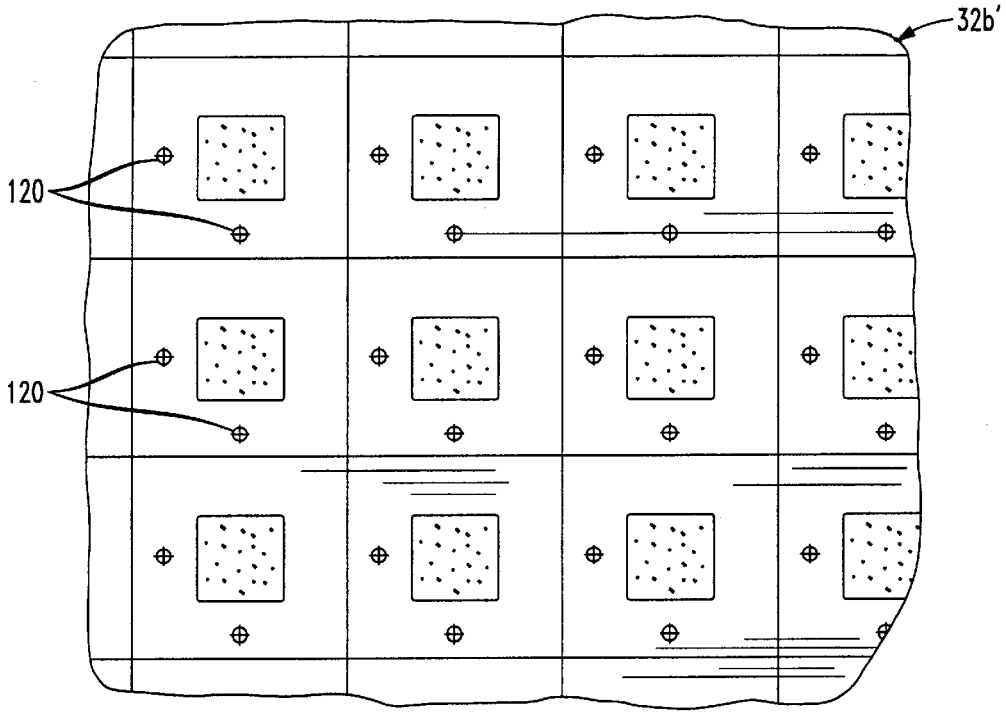
FIG. 5 is an enlarged bottom plan view of a ferrite sheet having a pattern of sintering blocking material thereon as used in the inductor of the present invention.
Figure 6:
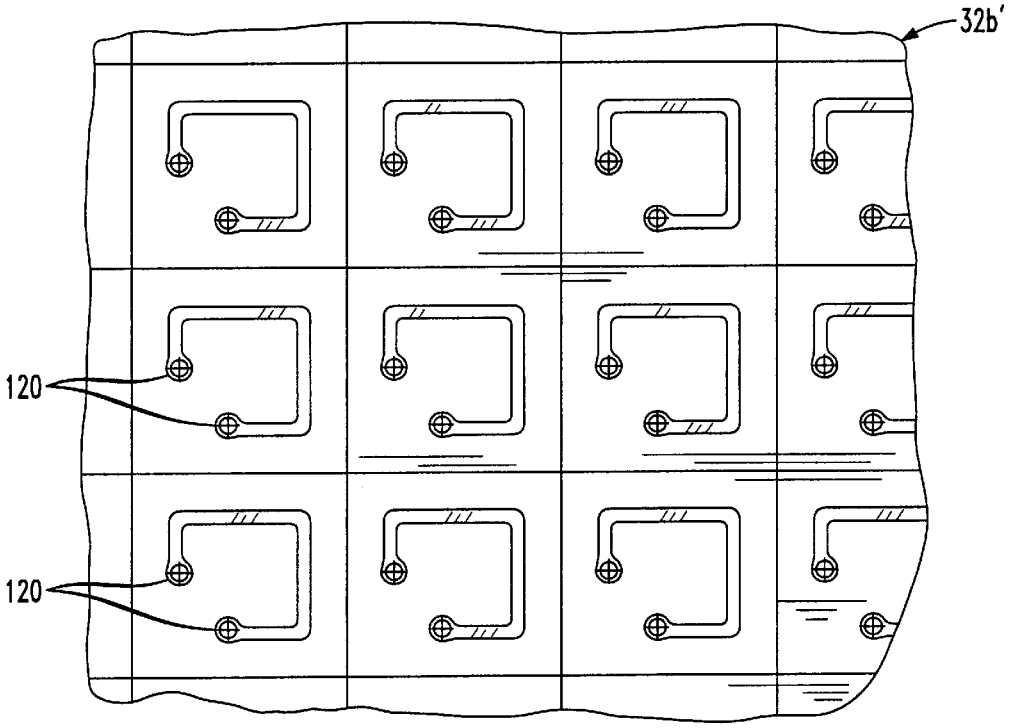
FIG. 6 is an enlarged top plan view of another ferrite sheet having another pattern of lateral electrical conductors thereon as used in the inductor of the present invention.
Figure 7:
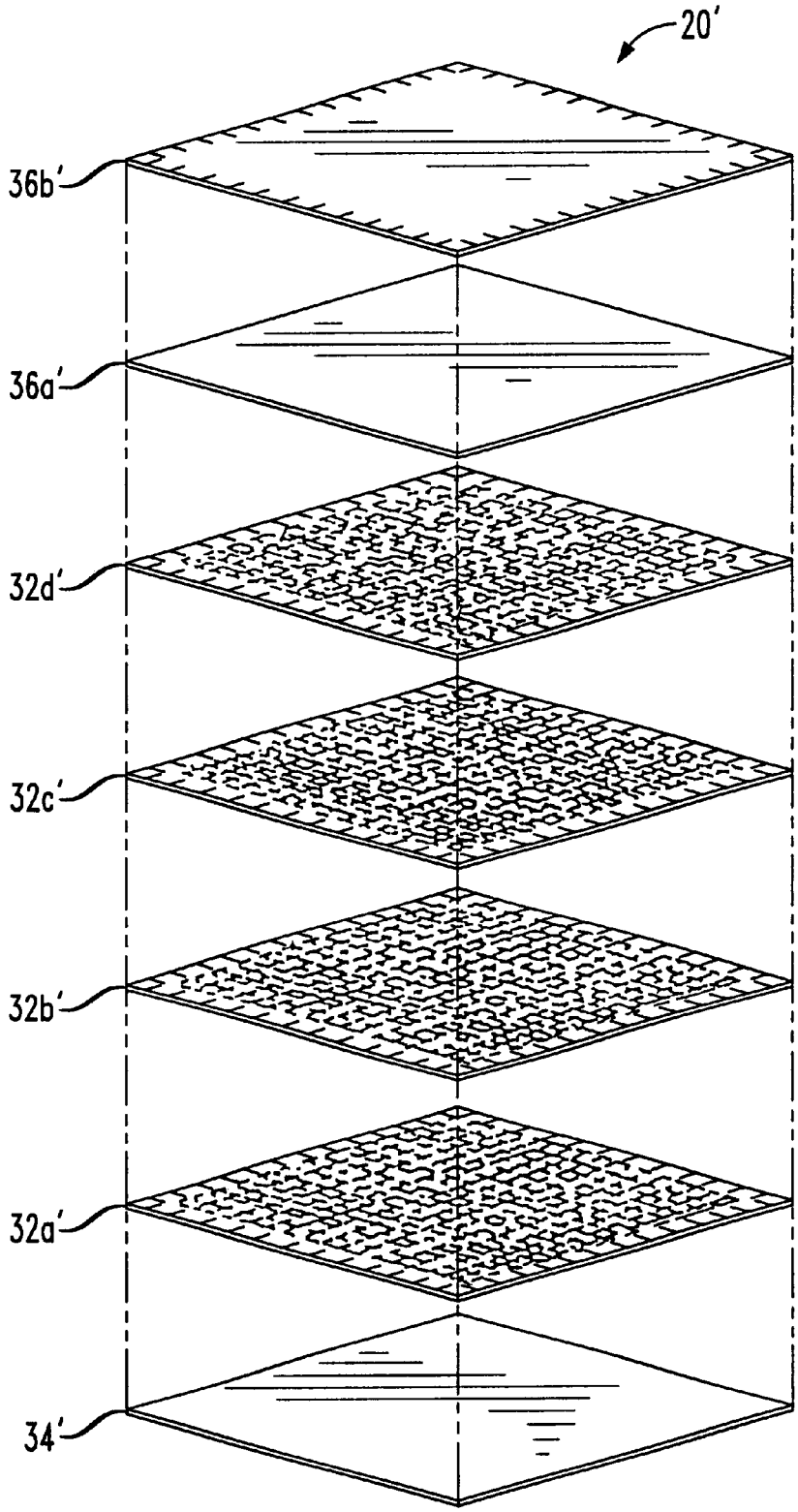
FIG. 7 is an exploded view illustrating the ferrite sheet for manufacturing a plurality of inductors of the present invention.
Figure 8:
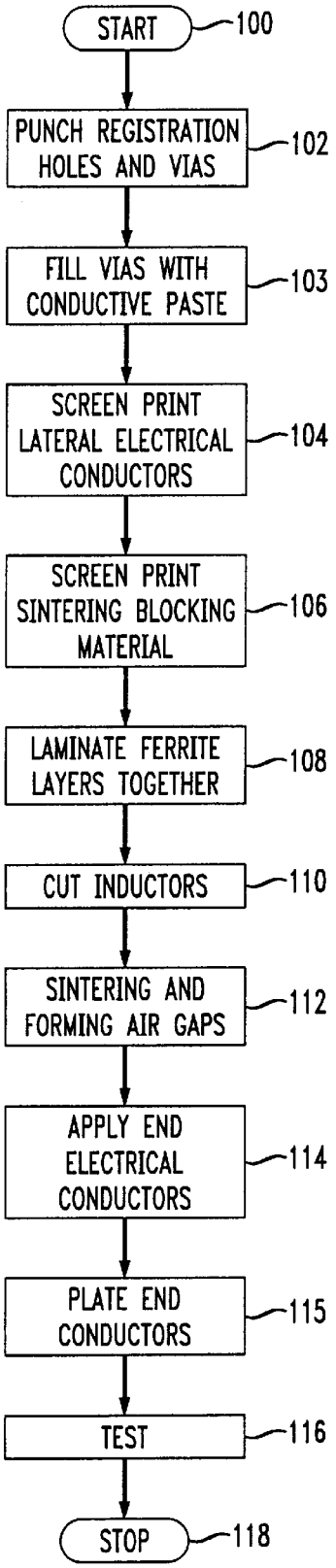
FIG. 8 is a flow chart illustrating the method of making inductors in accordance with the present invention.

Turning now additionally to FIGS. 5–7 and the flow chart of FIG. 8, the method of making the inductor in accordance with the present invention is now described in greater detail. In this portion of the description, prime notation is used to indicate ferrite sheets that will be used to simultaneously produce a relatively large number of inductors 20. These prime designations will correspond with the ferrite layers of FIG. 2 for clarity.

Figure 4:
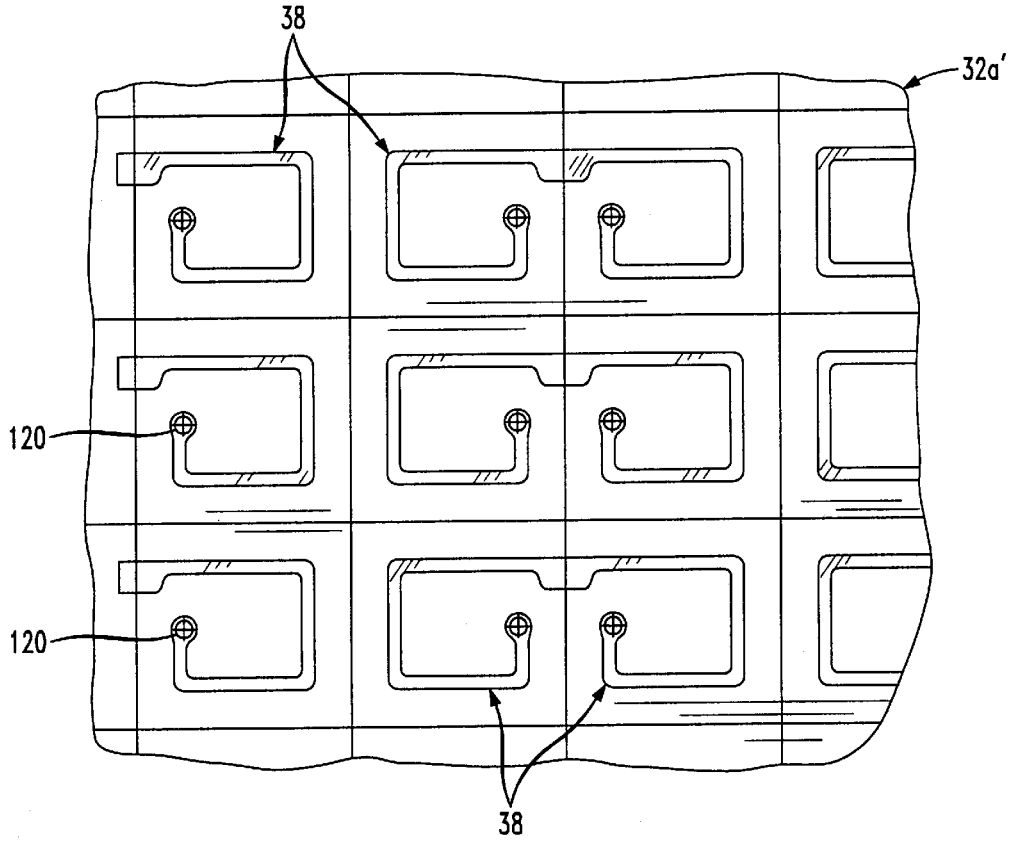
FIG. 4 is an enlarged top plan view of a ferrite sheet having a pattern of lateral electrical conductors thereon as used in the inductor of the invention.

From the start (Block 100) registration holes and vias are punched in the ferrite sheets to be assembled. At Block 103 the vias are filled with a conductive paste. Next at Block 104 the lateral electrical conductors are printed on the respective ferrite sheets. For example, FIG. 4 shows a top plan view of a portion of a ferrite sheet 32*a*' on which a plurality of lateral electrical conductors 38 are screen printed. Similarly, FIG. 6 is a top plan view illustrating the lateral electrical conductors 36 on a ferrite sheet 32*b*'. The other ferrite sheets 32*c*', 32*d*' are similarly prepared and require no further discussion. Those of skill in the art will readily appreciate that conventional conductor printing techniques may be used to form the conductors, and will appreciate that multiple printing steps may be used if thicker conductive patterns are desired.

The sintering blocking material is screen printed on the underside of the desired ferrite layers at Block 106. An example of the pattern of the sintering blocking material on the underside of the ferrite layer 32*b*' is shown in FIG. 5. Those of skill in the art will appreciate that a similar pattern of sintering blocking material may be formed on the underside of one of the top ferrite sheet 36*a*'.

The ferrite sheets are laminated together at Block 108. At Block 110, the partially completed inductors may be diced or cut according to techniques well known to those skilled in the art. The next step is to sinter the cut inductors at Block 112 by applying pressure and at a temperature sufficient to cause the adjacent ferrite portions to sinter or fuse together to form an almost monolithic body, except for those portions including the sintering blocking material. The end electrical conductors 24, 26 are then formed on the ends of the inductors (Block 114) by conventional printing and plating techniques as will also be understood by those skilled in the art. At Block 115, the end conductors are plated. The finished inductors 20 may then be tested at Block 116 before the manufacturing process ends at Block 118.

Figure 9:
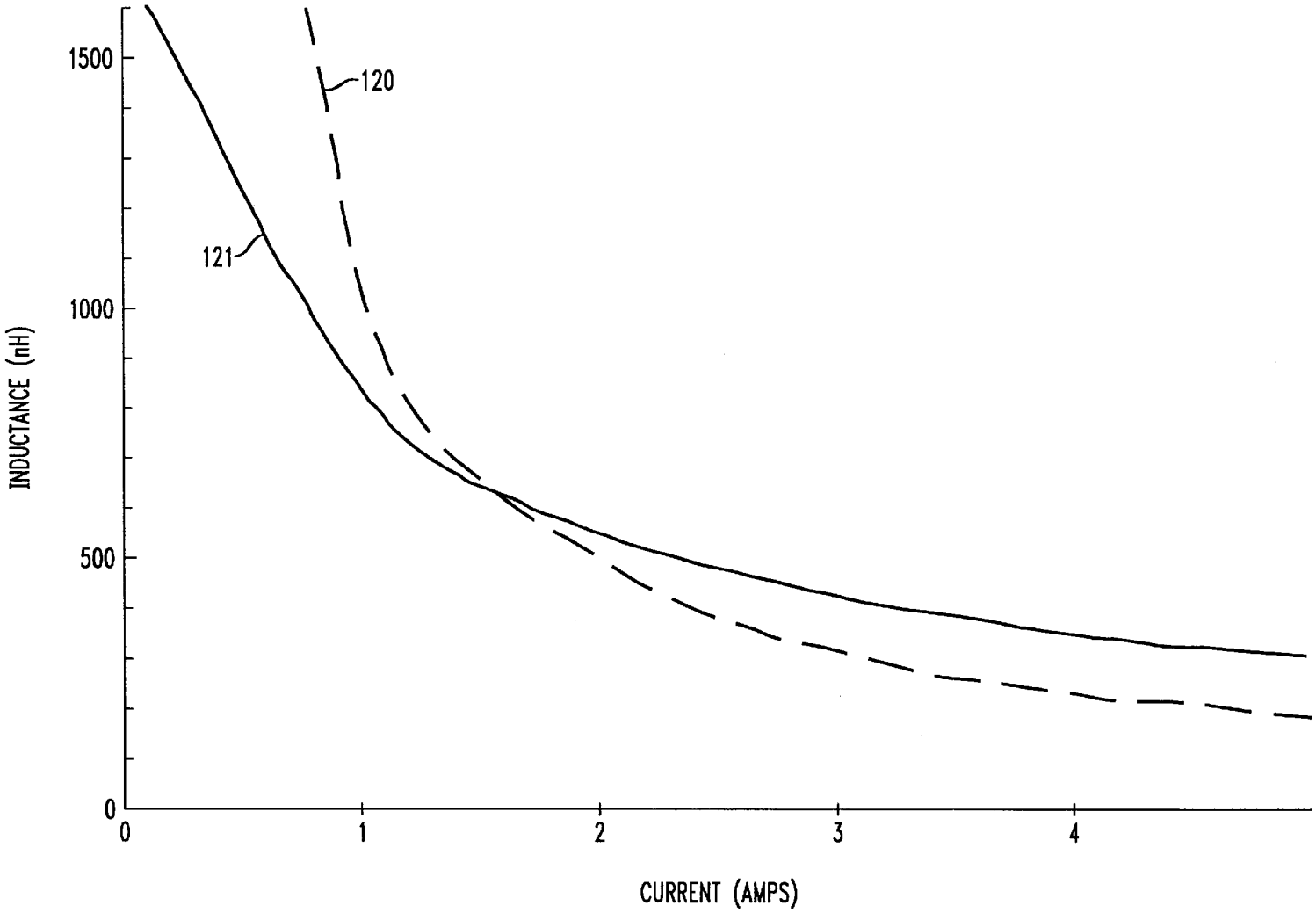
FIG. 9 is a graph of inductance versus current for an inductor having air gaps in accordance with the present invention and a similar inductor without the air gaps.

The inductor 20 according to the present invention including the upper and lower air gaps 63, 62 provides a higher inductance at higher operating currents. The increased performance is shown graphically in FIG. 9. More particularly, the dashed plot 120 represents the performance of an inductor as described herein, but without the air gaps to break the magnetic flux. In contrast, the plot 121 represents the performance of an inductor in accordance with the present invention. At the relatively high currents of 2 amps and particularly at 5 amps, the inductor 20 in accordance with the invention provides a greater inductance. The approximate dimensions of the inductor 20 tested were 0.220" (width)×0.200" (length)×0.136" (height). Accordingly, the high current performance and inductance is produced in a relatively small device suitable for surface mounting, for example, and which can be readily manufactured in accordance with the method aspects of the invention as will be appreciated by those skilled in the art.

The inductor 20 may be used in many applications, and is particularly well suited for EMI suppression and in low power converters. Of course, the technique of sintering blocking for a laminated ferrite inductor can be extended to many other components and applications as well. Thus, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An inductor comprising:

a plurality of ferrite layers arranged in stacked relation and joined together to define a ferrite body;

a first electrical conductor defining a loop extending between a first pair of adjacent ferrite layers;

first respective opposing portions of the first pair of adjacent ferrite layers outside the loop being sintered together;

second respective opposing portions of the first pair of adjacent ferrite layers within the loop being in spaced apart relation to define at least one first air gap therebetween; and a sintering blocking material associated with the at least one first air gap.

2. An inductor according to claim 1 wherein said ferrite body has a generally rectangular shape.

3. An inductor according to claim 2 further comprising a pair of end conductors on opposing ends of said ferrite body to facilitate surface mounting of the inductor.

4. An inductor according to claim 1 wherein said sintering blocking material comprises a nonmagnetic material.

5. An inductor according to claim 1 wherein said sintering blocking material comprises titanium-dioxide.

6. An inductor according to claim 1 wherein said sintering blocking material is at least partially diffused into adjacent ferrite layer portions.

7. An inductor according to claim 1 further comprising:

a second electrical conductor extending between a second pair of adjacent ferrite layers;

first respective opposing portions of the second pair of adjacent ferrite layers being sintered together;

second respective opposing portions of the second pair of adjacent ferrite layers being in spaced apart relation to define at least one second air gap therebetween; and a sintering blocking material associated with the at least one second air gap.

8. An inductor according to claim 7 wherein said first electrical conductor and said second electrical conductor are outermost electrical conductors.

9. An inductor according to claim 7 wherein at least one ferrite layer has at least one via extending therethrough; and further comprising an electrical conductor extending vertically through the at least one via.

10. An inductor according to claim 9 wherein each electrical conductor between respective adjacent ferrite layers comprises an enlarged width portion aligned in registration with each electrical conductor extending vertically.

11. A surface mount inductor comprising:

a plurality of ferrite layers arranged in stacked relation and joined together to define a generally rectangular ferrite body;

a first electrical conductor defining a loop extending between a first pair of adjacent ferrite layers;

first respective opposing portions of the first pair of adjacent ferrite layers outside the loop being sintered together;

second respective opposing portions of the first pair of adjacent ferrite layers within the loop being in spaced apart relation to define at least one first gap therebetween;

a sintering blocking material associated with the at least one first gap; and a pair of end conductors on opposing ends of the generally rectangular ferrite body to facilitate surface mounting.

12. A surface mount inductor according to claim 11 wherein said sintering blocking material comprises a non-magnetic material.

13. A surface mount inductor according to claim 11 wherein said sintering blocking material comprises titanium-dioxide.

14. A surface mount inductor according to claim 11 wherein said sintering blocking material is at least partially diffused into adjacent ferrite layer portions.

15. A surface mount inductor according to claim 11 further comprising:

a second electrical conductor extending between a second pair of adjacent ferrite layers;

first respective opposing portions of the second pair of adjacent ferrite layers being sintered together;

second respective opposing portions of the second pair of adjacent ferrite layers being in spaced apart relation to define at least one second gap therebetween; and a sintering blocking material associated with the at least one second gap.

16. A surface mount inductor according to claim 15 wherein said first electrical conductor and said second electrical conductor are outermost electrical conductors.

17. A surface mount inductor according to claim 15 wherein at least one ferrite layer has at least one via extending therethrough; and further comprising an electrical conductor extending vertically through the at least one via.

18. A surface mount inductor according to claim 17 wherein each electrical conductor between respective adjacent ferrite layers comprises an enlarged width portion aligned in registration with each electrical conductor extending vertically.

19. An inductor comprising:

a plurality of ferrite layers joined together to define a ferrite body;

at least one electrical conductor defining a loop extending within the ferrite body;

first respective opposing portions of a first pair of adjacent ferrite layers outside the loop being sintered together;

second respective opposing portions of the first pair of adjacent ferrite layers within the loop being in spaced apart relation to define at least one gap therebetween; and a sintering blocking material associated with the at least one gap.

20. An inductor according to claim 19 wherein said sintering blocking material comprises a non-magnetic material.

21. An inductor according to claim 19 wherein said sintering blocking material comprises titanium-dioxide.

22. An inductor according to claim 19 wherein at least portions of said sintering blocking material are diffused into adjacent ferrite layer portions.

23. An inductor comprising:

a plurality of ferrite layers arranged in stacked relation and joined together to define a ferrite body;

a first outermost electrical conductor defining a first loop extending between a first pair of adjacent ferrite layers;

first respective opposing portions of the first pair of adjacent ferrite layers outside the first loop being sintered together;

second respective opposing portions of the first pair of adjacent ferrite layers within the first loop being in spaced apart relation to define at least one first gap therebetween;

a sintering blocking material associated with the at least one first gap;

a second outermost electrical conductor defining a second loop extending between a second pair of adjacent ferrite layers;

first respective opposing portions of the second pair of adjacent ferrite layers outside the second loop being sintered together;

second respective opposing portions of the second pair of adjacent ferrite layers within the second loop being in spaced apart relation to define at least one second gap therebetween; and a sintering blocking material associated with the at least one second gap.

24. An inductor according to claim 23 wherein said ferrite body has a generally rectangular shape.

25. An inductor according to claim 23 further comprising a pair of end conductors on opposing ends of said ferrite body to facilitate surface mounting of the inductor.

26. An inductor according to claim 23 wherein said sintering blocking material comprises a non-magnetic material.

27. An inductor according to claim 23 wherein said sintering blocking material comprises titanium-dioxide.

28. An inductor according to claim 23 wherein said sintering blocking material is at least partially diffused into adjacent ferrite layer portions.

29. An inductor according to claim 23 wherein said first electrical conductor defines at least a portion of a first loop; wherein said at least one gap is within said first loop; wherein said second electrical conductor defines at least a portion of a second loop; and wherein said at least one second gap is within said second loop.

* * * * *